US008261680B2

(12) United States Patent
Oe

(10) Patent No.: US 8,261,680 B2
(45) Date of Patent: Sep. 11, 2012

(54) DECORATION-MAKING ASSIST TOOL AND METHOD FOR MAKING A DECORATION ITEM

(75) Inventor: Kanako Oe, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 0 days.

(21) Appl. No.: 13/311,174

(22) Filed: Dec. 5, 2011

(65) Prior Publication Data

US 2012/0145058 A1 Jun. 14, 2012

(30) Foreign Application Priority Data

Dec. 14, 2010 (JP) ..... 2010-277772

(51) Int. Cl.
*D05B 91/10* (2006.01)

(52) U.S. Cl. ..... 112/475.08; 112/260; 33/565

(58) Field of Classification Search ..... 112/136, 112/147, 148, 149, 475.01, 475.06, 475.08, 112/260; 33/565, 566, 574, 577
See application file for complete search history.

(56) References Cited

U.S. PATENT DOCUMENTS 4,608,939 A * 9/1986 Lampley ..... 112/260
5,363,561 A * 11/1994 Essary ..... 33/562
5,791,062 A * 8/1998 Walker ..... 33/563
6,155,189 A * 12/2000 Walner ..... 112/475.01
6,413,091 B1 * 7/2002 Fields ..... 434/95
7,350,473 B2 * 4/2008 Henry ..... 112/475.08
7,383,640 B2 * 6/2008 Barry ..... 33/562
7,854,073 B1 * 12/2010 Webb ..... 33/566
8,156,877 B1 * 4/2012 Carr ..... 112/117
8,186,072 B1 * 5/2012 Nethery ..... 33/565
8,186,073 B2 * 5/2012 Nethery ..... 33/566
2008/0171171 A1 * 7/2008 Kuwabara ..... 428/41.8
2012/0145058 A1 * 6/2012 Oe ..... 112/136

OTHER PUBLICATIONS

Hong Presents, "Tsumami-zaiku: Flower", pp. 12-15. Patchwork Tsushin Co., Ltd., publishers, Dec. 3, 2009.

* cited by examiner

*Primary Examiner* — Danny Worrell, Jr.
(74) *Attorney, Agent, or Firm* — Hamre, Schumann, Mueller & Larson, P.C.

(57) ABSTRACT

A decoration-making assist tool includes a first and a second plates. Each plate includes a straight base edge and a peripheral edge connected to the ends of the base edge. A connecting portion pivotally connects the two plates to each other so that they can be folded to overlap each other. The first plate includes recesses formed at the peripheral edge and N elongated holes. The second plate includes (N+1) elongated holes. The ends of these elongated holes are adjacent to the peripheral edges of the plates. When the two plates overlap each other, the recesses and the ends of the elongated holes of the first plate communicate with corresponding ends of the elongated holes of the second plate.

8 Claims, 13 Drawing Sheets

DECORATION-MAKING ASSIST TOOL AND METHOD FOR MAKING A DECORATION ITEM

BACKGROUND OF THE INVENTION

1. Field of the Invention

The present invention relates to a decoration-making assist tool suitably used for making a decoration item from cloth.

2. Description of the Related Art

In the field of handcrafts such as patchworks, "tsumami zaiku" in Japanese (meaning cloth pinching work) is known as a technique of making a decoration item for attachment to goods or the like to provide good decoration effect. The making of a decoration item by "tsumami zaiku" is performed by preparing a plurality of decoration units one by one by pinching and folding a piece of cloth and then bonding the decoration units together by using an adhesive or by sewing.

Specifically, in an example of a method for making a decoration item by "tsumami zaiku", marks are first put on a piece of cloth by using a pattern or the like, and then the cloth is cut into a predetermined size in accordance with the marks. Then, the cloth is folded a plurality of times, following the process shown in a manual or the like. Then, ends of the cloth are bonded together with an adhesive such that the cloth includes holds, whereby one decoration unit is obtained. By making a plurality of decoration units in the above-described manner and bonding the decoration units one another or to a base, a decoration item is obtained. See "Tsumami-zaiku: Flower" pp. 12-15 written by hong presents, published on Dec. 3, 2009 by Patchwork Tsushin Co., Ltd.

In making a decoration item by the above-described conventional "tsumami zaiku", it is difficult to make a plurality of decoration units having a uniform shape. Further, making a lot of decoration items requires significant time and effort.

SUMMARY OF THE INVENTION

The present invention has been proposed under the circumstances described above. It is therefore an object of the present invention to provide a decoration-making assist tool that allows easy and efficient making of a decoration item from cloth by "tsumami zaiku", for example. Another object of the present invention is to provide a method for making a decoration item using such a decoration-making assist tool.

To solve the above-described problems, the present invention takes the following technical measures.

According to a first aspect of the present invention, there is provided a decoration-making assist tool for making a decoration item by sewing cloth. The decoration-making assist tool comprises: a first plate and a second plate each of which includes a straight base edge and a peripheral edge connected to ends of the base edge; and a connecting portion connecting the first plate and the second plate to, each other at the base edges such that the first plate and the second plate are pivotable relative to each other. The peripheral edge of the first plate and the peripheral edge of the second plate are substantially symmetrical with respect to the connecting portion. The first plate and the second plate are foldable to overlap each other. The first plate includes a first and a second recesses indented inward at the peripheral edge and a first group of elongated holes including a first to an Nth elongated holes spaced from each other, where N is an integer equal to or greater than two. The second plate includes a second group of elongated holes including a first to an (N+1)th elongated holes spaced from each other. Each of the elongated holes of the first group includes opposite ends positioned adjacent to the peripheral edge of the first plate; and each of the elongated holes of the second group includes opposite ends positioned adjacent to the peripheral edge of the second plate. When the first plate and the second plate overlap each other, the first recess and one end of the first elongated hole of the second group communicate with each other. Likewise, another or the other end of an (i)th elongated hole of the second group communicates with one end of an (i)th elongated hole of the first group, where i is an integer that satisfies $1 \leqq i \leqq N$, another or the other end of the (i)th elongated hole of the first group communicates with one end of an (i+1)th elongated hole of the second group, and another or the other end of the (N+1)th elongated hole of the second group communicates with the second recess.

In a preferred embodiment of the present invention, the first and the second plates are provided with numerical marks for showing the order in which a needle is to be passed through. The numerical marks are adjacent to the first and the second recesses and the opposite ends of the elongated holes of the first and the second groups.

In a preferred embodiment of the present invention, the numerical marks are applied such that, of the first and the second recesses and the opposite ends of each of the elongated holes of the first and the second groups, paired ones that communicate with each other when the first plate and the second plate overlap each other are provided with the same number, while the opposite ends of each of the elongated holes of the first group and the second group are provided with successive numbers.

In a preferred embodiment of the present invention, the opposite ends of each of the elongated holes of the first and the second groups are larger in width than an intermediate portion of the elongated hole connected to the opposite ends.

In a preferred embodiment of the present invention, the decoration-making assist tool further comprises a lock for keeping an overlapping state of the first and the second plates.

In a preferred embodiment of the present invention, the first plate and the second plate include surfaces that face each other when the first plate and the second plate overlap each other, and the surfaces are formed with projections extending in the direction in which the base edges extend.

According to a second aspect of the present invention, there is provided a method of making a decoration item by using the decoration-making assist tool according to the first aspect of the present invention, where the method comprises: a first step of sandwiching a piece of cloth between the first plate and the second plate by placing the piece of cloth on the first plate and the second plate when these plates are unfolded, and folding the first plate and the second plate to overlap each other; a second step of cutting off an unnecessary portion of the piece of cloth along the peripheral edges of the first plate and the second plate in the overlapping state; a third step of sewing the piece of cloth by a needle with a thread by inserting the needle into the first recess of the first plate and pulling out the needle from one end of the first elongated hole of the second group of the second plate, inserting the needle into the other end of the (i)th elongated hole of the second group of the second plate and pulling out the needle from one end of the (i)th elongated hole of the first group of the first plate, inserting the needle into the other end of the (i)th elongated hole of the first group of the first plate and pulling out the needle from one end of the (i+1)th elongated hole of the second group of the second plate, inserting the needle into the other end of the (N+1)th elongated hole of the second group of the second plate and pulling out the needle from the second recess of the first plate; a fourth step of removing the piece of cloth from the decoration-making assist tool by unfolding the first plate and the second plate; and a fifth step of forming a decoration unit by tightening the thread.

Preferably, in the second aspect of the present invention, the first through the fifth steps are performed again to make another decoration unit using the thread extending from the first decoration unit so that a decoration item including the decoration units is obtained.

Other features and advantages of the present invention will become more apparent from detailed description given below with reference to the accompanying drawings.

BRIEF DESCRIPTION OF THE DRAWINGS

FIG. 8A shows the obverse side, whereas FIG. 8B shows the reverse side.

FIG. 9A shows the obverse side, whereas FIG. 9B shows the reverse side.

DETAILED DESCRIPTION OF THE PREFERRED EMBODIMENTS

Figure 1:
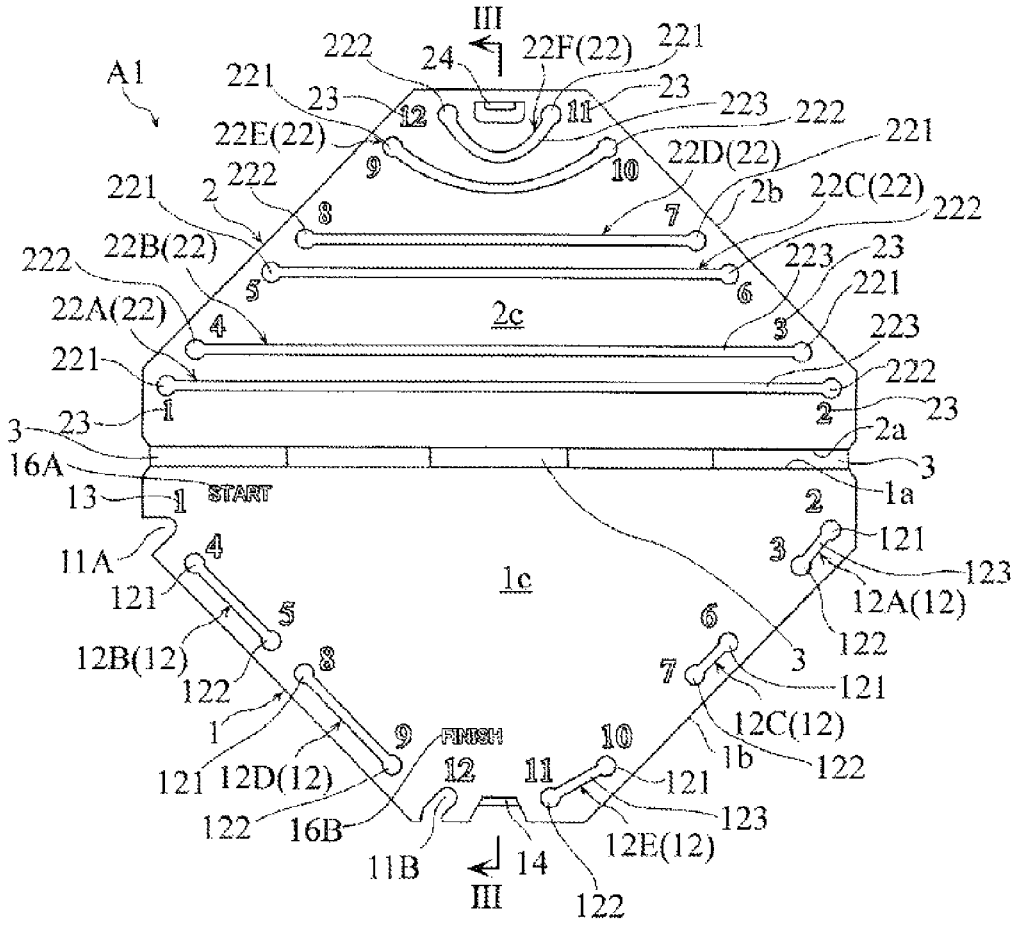
FIG. 1 is a plan view showing a decoration-making assist tool according to a first embodiment of the present invention.

Preferred embodiments of the present invention are described below with reference to the accompanying drawings.

FIGS. 1-5 show a decoration-making assist tool according to a first embodiment of the present invention. The decoration-making assist tool A1 of this embodiment includes a pair of plates 1 and 2, a connecting portion 3 and a lock 4 (see FIG. 5). The decoration-making assist tool A1 is made of a synthetic resin having a predetermined strength, such as polypropylene, as a single-piece member. The decoration-making assist tool A1 is used for sewing cloth to make a decoration item of a predetermined shape, by means of "tsumami zaiku", for example.

The plate 1 has a substantially uniform thickness overall and has a predetermined shape defined by a base edge 1*a* in the form of a straight line and a peripheral edge 1*b* connected to the ends of the base edge 1*a*.

The plate 1 has recesses 11A and 11B at predetermined positions. The recesses 11A and 11B are formed by recessing part of the peripheral edge 1*b* inward. The plate 1 further includes a plurality of elongated holes 12 penetrating the plate 1 in the thickness direction. In this embodiment, five, i.e., a first to a fifth elongated holes 12 are provided, which are hereinafter referred to as elongated holes 12A, 12B, 12C, 12D and 12E, respectively, as required. The elongated holes 12A-12E are spaced from each other, and arranged adjacent to the peripheral edge 1*b* in this embodiment. Each of the elongated-holes 12 includes two ends 121, 122 and an intermediate portion 123 connected to the ends 121, 122. The ends 121, 122 of each elongated hole 12 are also positioned adjacent to the peripheral edge 1*b*.

The width of the ends 121, 122 of each elongated hole 12 is larger than that of the intermediate portion 123. In this embodiment, the ends 121, 122 are generally in the form of a circle of a size that allows easy insertion of a needle. For instance, the diameter (width) of each end 121, 122 is about 2 mm. The intermediate portion 123 has a constant width, which is e.g. about 1 mm.

As shown in FIG. 1, the plate 1 includes a first surface 1*c* provided with numerical marks 13. The numerical marks 13 are provided adjacent to the recesses 11A, 11B and the ends 121, 122 of the elongated holes 12. The numerical marks 13 are provided for showing the order in which the needle is to be passed through, which will be described later. The numerical marks 13 may be formed by e.g. partially denting the first surface 1*c* of the plate 1. In this embodiment, a "START" mark 16A indicating the position where the sewing is to be started is provided adjacent to the numerical mark 13 corresponding to the recess 11A. A "FINISH" mark 16B indicating the position where the sewing is to be finished is provided adjacent to the numerical mark 13 corresponding to the recess 11B.

The plate 1 has an engagement portion 14 at the tip end. As shown in FIG. 1, the engagement portion 14 is provided at a portion where the peripheral edge 1*b* is dented inward. As better shown in FIGS. 2 and 3, the plate 1 has a second surface 1*d* formed with a plurality of projections 15 extending in the direction in which the base edge 1*a* extends.

Figure 2:
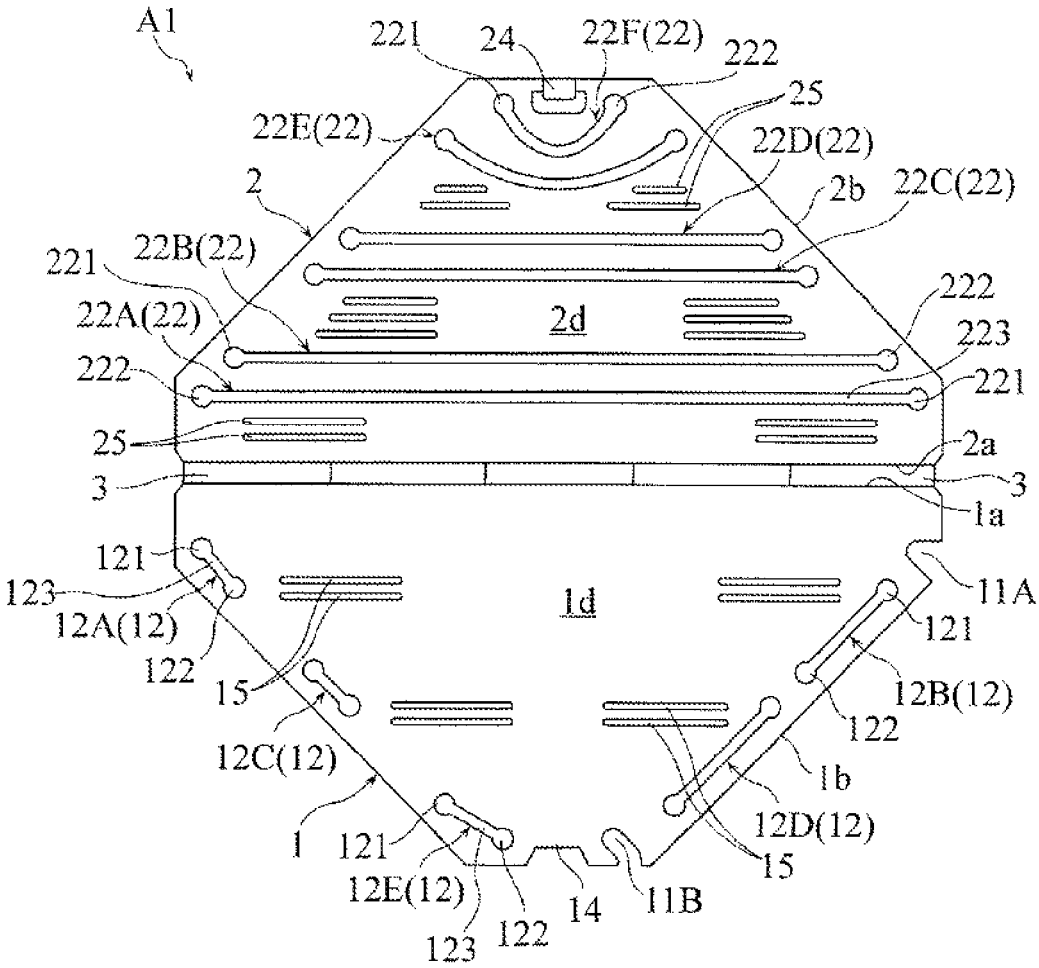
FIG. 2 shows the reverse side of the decoration-making assist tool of FIG. 1.
Figure 3:
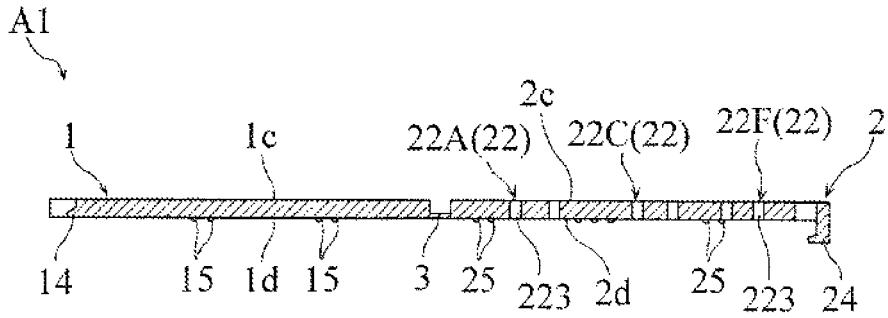
FIG. 3 is a sectional view taken along lines in FIG. 1.
Figure 4:
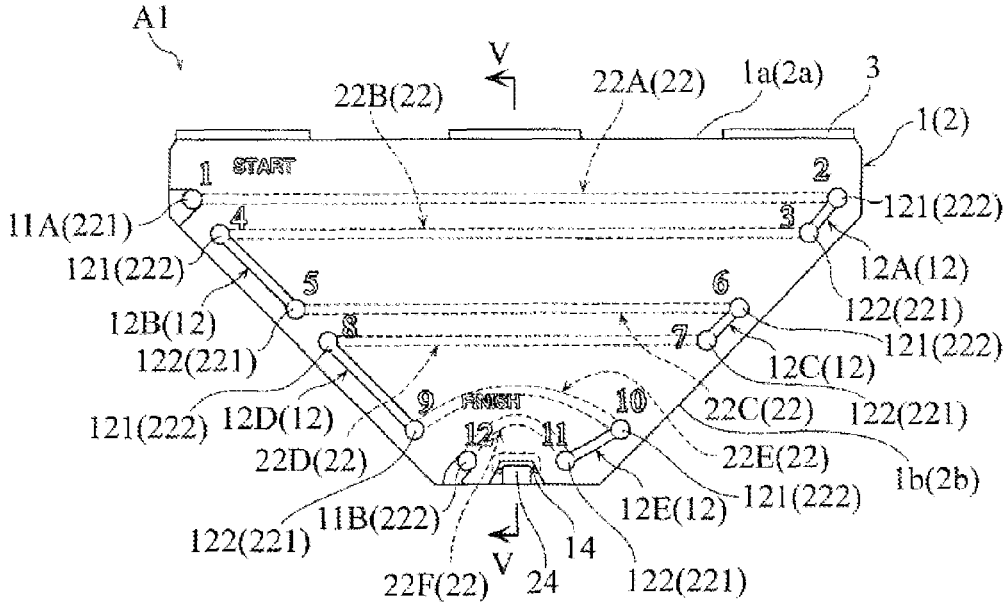
FIG. 4 is a plan view showing the decoration-making assist tool in a state in which the first plate and the second plate overlap each other.
Figure 5:
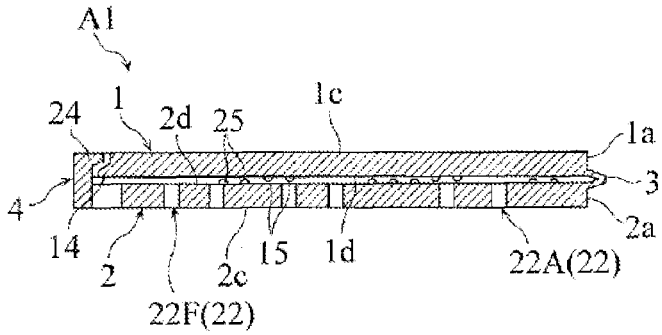
FIG. 5 is a sectional view taken along lines V-V in FIG. 4.

Similarly to the plate 1, the plate 2 has a substantially uniform thickness overall and has a shape defined by a base edge 2*a* in the form of a straight line and a peripheral edge 2*b* connected to the ends of the base edge 2*a*. The plate 2 and the plate 1 are connected to each other via the connecting portion 3 having a relatively small thickness. With this arrangement, the plate 2 is pivotable relative to the plate 1 at the connecting portion 3. FIGS. 1-3 show the unfolded state of the plates 1 and 2. As shown in FIGS. 4 and 5, the plate 2 can be folded to overlap the plate 1.

The plate 2 includes a plurality of elongated holes 22 penetrating the plate 2 in the thickness direction. In this embodiment, six, i.e., a first to a sixth elongated holes 22 are provided, which are hereinafter referred to as elongated holes 22A, 22B, 22C, 22D, 22E and 22F, respectively, as required. The number of the elongated holes 22 is greater than that of the elongated holes 12 of the plate 1 by one. The elongated holes 22 are spaced from each other. Each of the elongated-holes 22 includes two ends 221, 222 and an intermediate portion 223 connected to the ends 221, 222. The ends 221, 222 of each elongated hole 22 are positioned adjacent to the peripheral edge 2*b*.

The width of the ends 221, 222 of each elongated hole 22 is larger than that of the intermediate portion 223. In this embodiment, the ends 221, 222 are generally in the form of a circle of a size that allows easy insertion of a needle. For instance, the diameter (width) of each end 221, 222 is about 2 mm. The intermediate portion 223 has a constant width, which is e.g. about 1 mm.

As shown in FIG. 1, the plate 2 includes a first surface 2*c* provided with numerical marks 23. The numerical marks 23 are provided adjacent to the ends 221, 222 of the elongated holes 22. The numerical marks 23 are provided for showing the order in which the needle is to be passed through, which will be described later. The numerical marks 23 may be formed by e.g. partially denting the first surface 2*c* of the plate 2.

The plate 2 has an engagement portion 24 at the tip end. As shown in FIG. 3, the engagement portion 24 is in the form of a hook extending vertically from the second surface 2*d* of the plate 2 and projecting inward (toward the base edge 2*a*) at the end. As shown in FIGS. 2 and 3, the second surface 2*d* of the plate 2 is formed with a plurality of projections 25 extending in the direction in which the base edge 2*a* extends.

As shown in FIG. 1, the peripheral edge 1*b* of the plate 1 and the peripheral edge 2*b* of the plate 2 are substantially symmetrical with respect to the connecting portion 3. Herein, the "substantially symmetrical" means that certain portions of the peripheral edge 1*b* and the peripheral edge 2*b* are not symmetrical due to the presence of the recesses 11A, 11B and the engagement portion 14. In other words, the peripheral edge 1*b* and the peripheral edge 2*b* are symmetrical at most portions except the recesses 11A, 11B and the engagement portion 14. Since the peripheral edges 1*b* and 2*b* are symmetrical in this way, when the plates 1 and 2 are folded to overlap each other, the peripheral edges 1*b* and 2*b* overlap each other in the in-plane direction, as shown in FIG. 4.

As shown in FIG. 4, when the plates 1 and 2 are folded to overlap each other, the recesses 11A, 11B and the ends 121, 122 of the elongated holes 12A-12E of the plate 1 communicate with the ends 221, 222 of the elongated holes 22A-22F of the plate 2.

Specifically, the recess 11A of the plate 1 communicates with one end 221 of the first elongated hole 22A of the plate 2. The numerical mark 13, 23 corresponding to these recess 11A and end 221 is "1". The other end 222 of the elongated hole 22A communicates with one end 121 of the first elongated hole 12A of the plate 1. The numerical mark 23, 13 corresponding to these ends 222 and 121 is "2". The other end 122 of the elongated hole 12A communicates with one end 221 of the second elongated hole 22B of the plate 2. The numerical mark 13, 23 corresponding to these ends 122 and 221 is "3". The other end 222 of the elongated hole 22B communicates with one end 121 of the second elongated hole 12B of the plate 1. The numerical mark 23, 13 corresponding to these ends 222 and 121 "4". The other end 122 of the elongated hole 12B communicates with one end 221 of the third elongated hole 22C of the plate 2. The numerical mark 13, 23 corresponding to these ends 122 and 221 is "5". The other end 222 of the elongated hole 22C communicates with one end 121 of the third elongated hole 12C of the plate 1. The numerical mark 23, 13 corresponding to these ends 222 and 121 is "6". The other end 122 of the elongated hole 12C communicates with one end 221 of the fourth elongated hole 22D of the plate 2. The numerical mark 13, 23 corresponding to these ends 122 and 221 is "7". The other end 222 of the elongated hole 22D communicates with one end 121 of the fourth elongated hole 12D of the plate 1. The numerical mark 23, 13 corresponding to these ends 222 and 121 is "8". The other end 122 of the elongated hole 12D communicates with one end 221 of the fifth elongated hole 22E of the plate 2. The numerical mark 13, 23 corresponding to these ends 122 and 221 is "9". The other end 222 of the elongated hole 22E communicates with one end 121 of the fifth elongated hole 12E of the plate 1. The numerical mark 23, 13 corresponding to these ends 222 and 121 is "10". The other end 122 of the elongated hole 12E communicates with one end 221 of the sixth elongated hole 22F of the plate 2. The numerical mark 13, 23 corresponding to these ends 122 and 221 is "11". The other end 222 of the elongated hole 22F communicates with the recess 11B of the plate 1. The numerical mark 23, 13 corresponding to these end 222 and recess 11B is "12".

As will be understood from the above, the numerical marks 13, 23 are applied such that, of the recesses 11A, 11B and the ends 121, 122, 221, 222 of the elongated holes 12, 22, the paired-ones which communicate with each other when the plates 1 and 2 are folded are provided with a same number. Further, the numerical marks 13, 23 are applied such that one end 121 and the other end 122 of each elongated hole 12 are provided with successive numbers, so are one end 221 and the other end 222 of each elongated hole 22.

As shown in FIG. 5, when the plates 1 and 2 are folded to overlap each other, the second surface id of the plate 1, which is provided with the projections 15, and the second surface 2*d* of the plate 2, which is provided with the projections 25 face each other.

The lock 4 is provided for keeping the overlapping state of the plates 1 and 2. The engagement portion 14 of the plate 1 and the engagement portion 24 of the plate 2 constitute the lock 4. When the plate 2 and the plate 1 are folded to overlap each other, the tip of the hook-like engagement portion 24 comes into contact with the tip of the engagement portion 14. In this state, when the plate 2 is pressed against the plate 1 with a load exceeding a predetermined level, the engagement portion 24 slightly deforms elastically to pass over the engagement portion 14 and engage with the engagement portion 14. Thus, when the plate 1 and the plate 2 are in the overlapping state, movement of the plate 2 relative to the plate 1 in the separating direction is prevented.

A method of making a decoration item from cloth by using the decoration-making assist tool A1 having the above-described structure is described below with reference to FIGS. 6-14.

Figure 6:
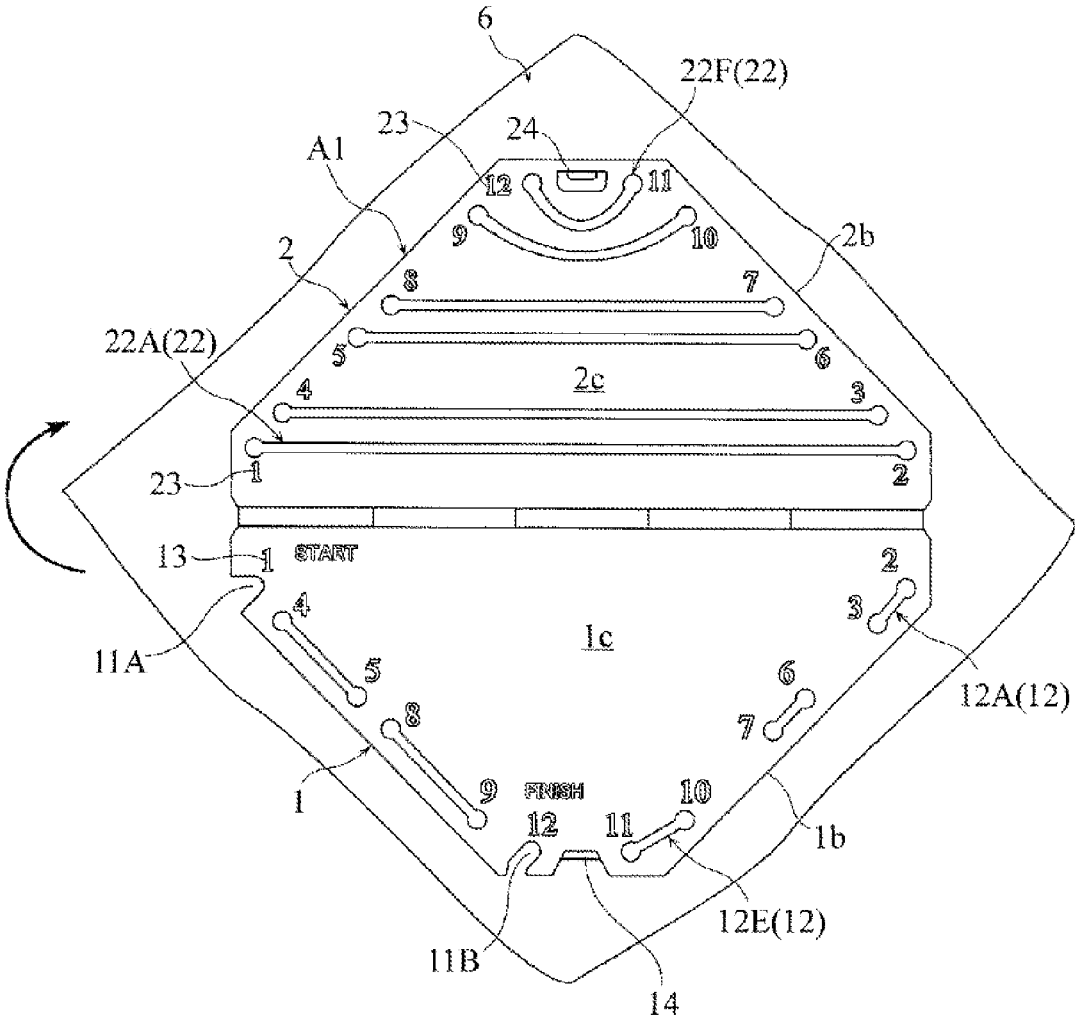
FIG. 6 is a plan view showing a step in the process of making a decoration item using the decoration-making assist tool shown in FIG. 1.

First, as shown in FIG. 6, the decoration-making assist tool A1 (the plates 1 and 2 in the unfolded state) is placed on a piece of cloth 6 of a size slightly larger than the decoration-making assist tool A1. Then, the plates 1 and 2 are folded to overlap each other with the cloth 6 sandwiched between them. The engagement portion 14 of the plate 1 and the engagement portion 24 of the plate 2 are brought into engagement with each other, with the cloth 6 sandwiched between these engagement portions 14, 24.

Figure 7:
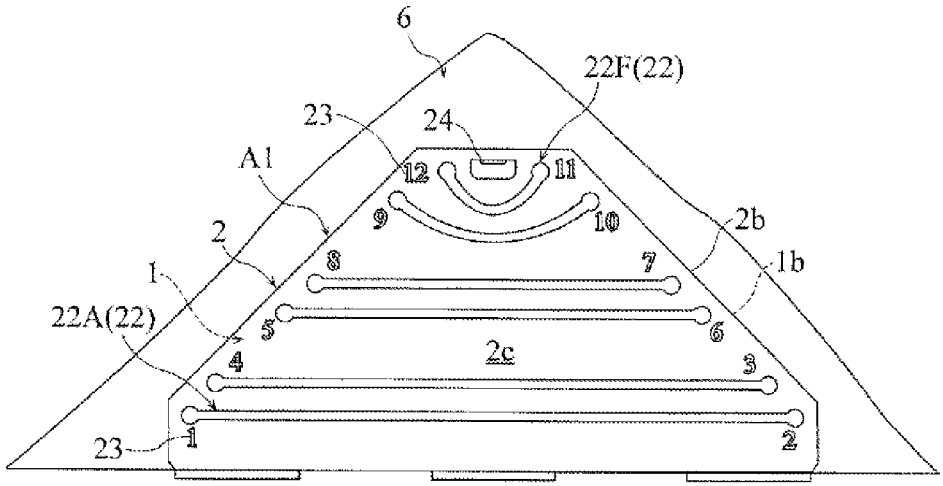
FIG. 7 is a plan view showing a step in the process of making a decoration item using the decoration-making assist tool shown in FIG. 1.

Then, as shown in FIG. 7, the cloth 6 is cut along the outer edge (peripheral edges 1*b*, 2*b*) of the plates 1 and 2 to remove unnecessary portions. In this step, the plates 1 and 2 overlapping each other serve as a pattern. Since the cloth 6 is sandwiched between the plates 1 and 2, putting a mark on the cloth 6, which is performed in the case where a pattern is used, is not necessary. Moreover, since the peripheral edges 1*b* and 2*b* of the plates 1 and 2 overlap each other in the in-plane direction, the plates 1 and 2 can suitably function as a pattern regardless of which one of the two plates 1 and 2 is on the obverse side.

When the plates 1 and 2 are in the overlapping state, the cloth 6 is pressed by the projections 15 and 25 provided on the surfaces 1*d* and 2*d* facing each other. Thus, the cloth 6 does not move easily, which assures that the work of cutting the cloth 6 into a predetermined size is performed efficiently.

Figure 8A:
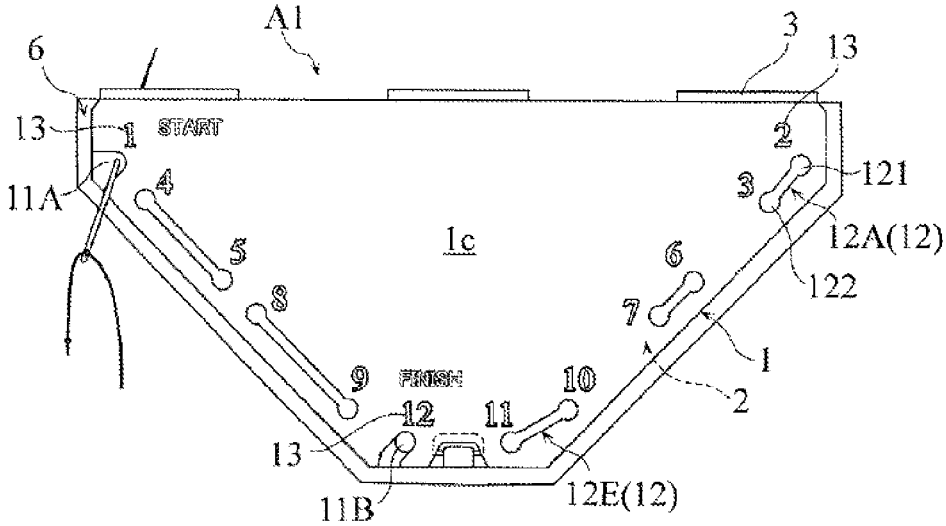
FIGS. 8A and 8B are plan views showing a step in the process of making a decoration item using the decoration-making assist tool shown in FIG. 1.
Figure 8B:
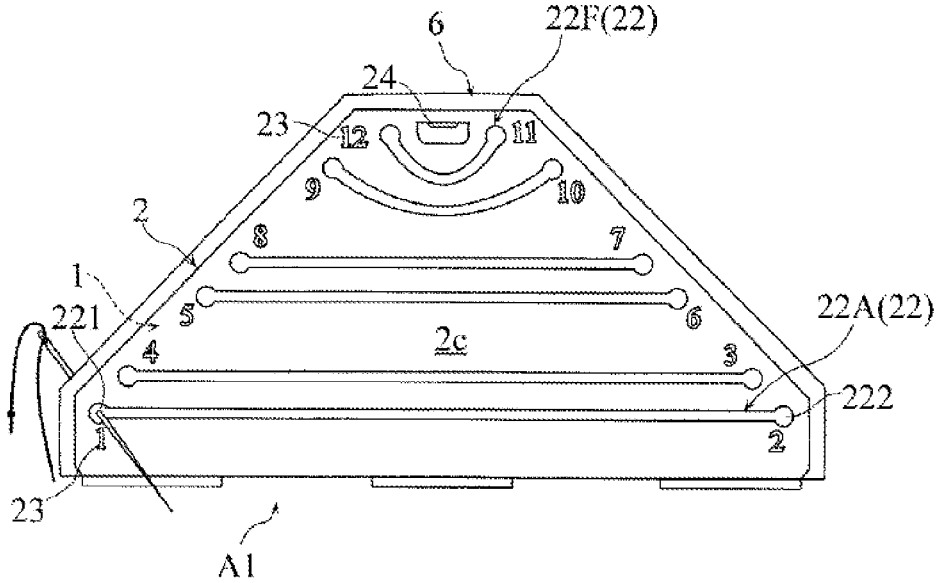

Then, a needle is passed through the plates 1, 2 in the order indicated by the numerical marks 13, 23 to sew the two sides of the folded cloth 6 together. Specifically, first, before starting the sewing, a thread is pushed through a needle, and a knot is made at an end of the thread. Then, as shown in FIG. 8, the needle is inserted into the recess 11A corresponding to the number "1" of the numerical mark 13 of the plate 1 and pulled out from the end 221 of the first elongated hole 22A corresponding to the number "1" of the numerical mark 23 of the opposite plate 2. Then, the needle is inserted into the end 222 of the elongated hole 22A corresponding to the number "2" of the numerical mark 23 of the plate 2 and pulled out from the end 121 of the first elongated hole 12A corresponding to the number "2" of the numerical mark 13 of the opposite plate 1. Then, the needle is inserted into the end 122 of the elongated hole 12A corresponding to the number "3" of the numerical mark 13 of the plate 1 and pulled out from the end 221 of the second elongated hole 22B corresponding to the number "3" of the numerical mark 23 of the opposite plate 2.

Figure 9A:
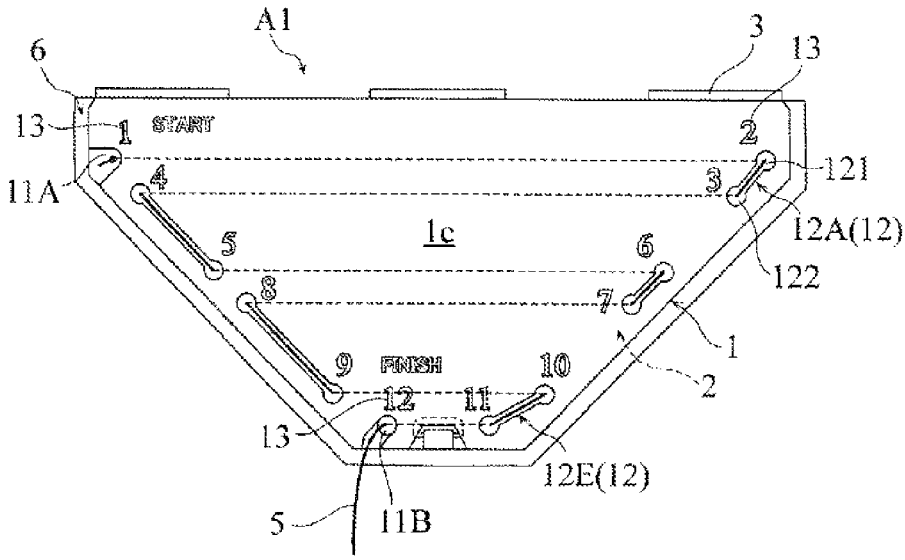
FIGS. 9A and 9B are plan views showing a step in the process of making a decoration item using the decoration-making assist tool shown in FIG. 1.
Figure 9B:
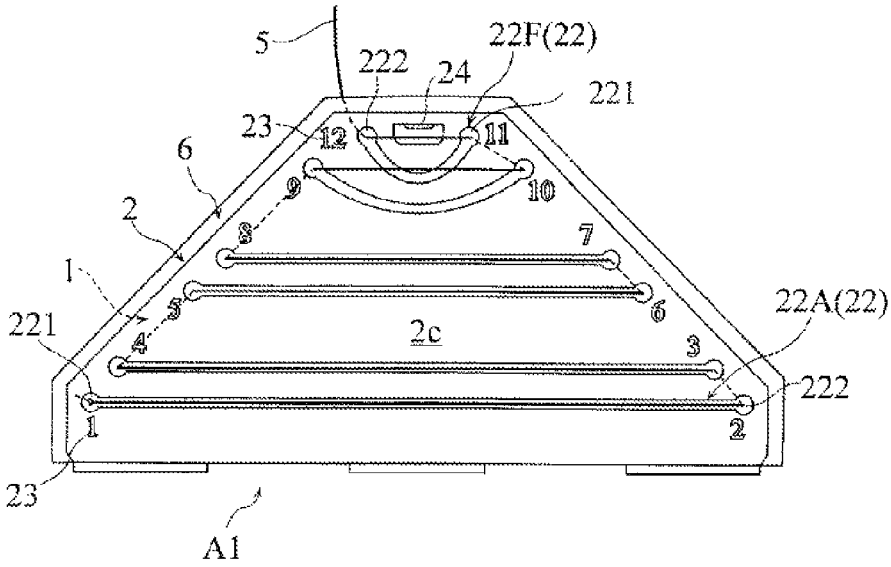
Figure 10:
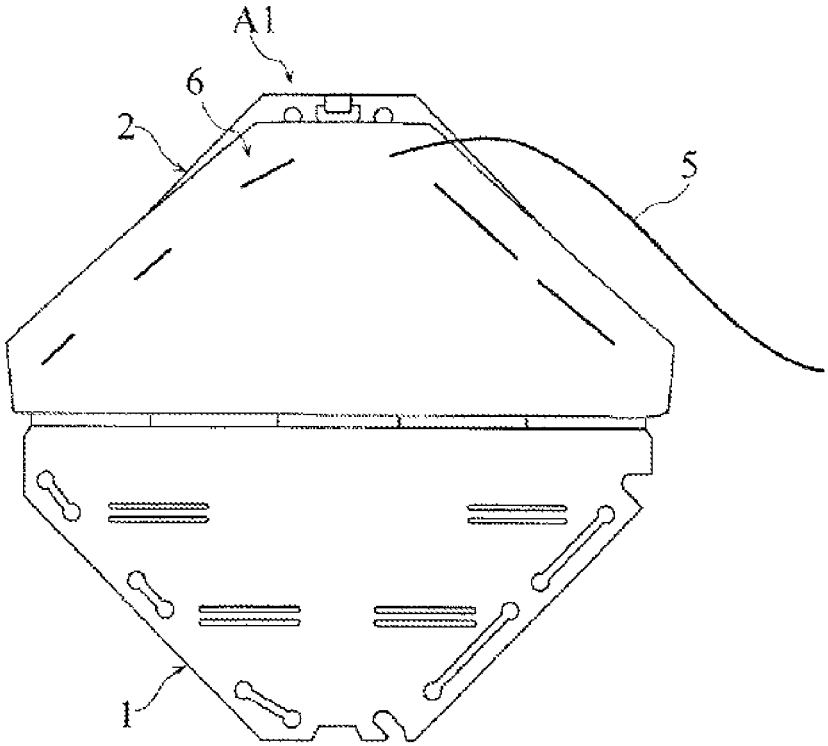
FIG. 10 is a plan view showing a step in the process of making a decoration item using the decoration-making assist tool shown in FIG. 1.

Thereafter, the work of passing a needle as described above is repetitively performed with respect to the numbers "4" to "11" of the numerical mark 13, 23 in the order of the numbers. Finally, the needle is inserted into the end 222 of the elongated hole 22F corresponding to the number "12" of the numerical mark 23 of the plate 2 and pulled out from the recess 11B of plate 1. Thus, the sewing work is finished. FIGS. 9A and 9B show the state after the sewing work is finished. As will be understood from the state of the thread 5 in these figures, there are formed stitches connecting the two ends 121 and 122 (221 and 222) of each elongated hole 12 (22). In FIGS. 9A and 9B, the thread 5 extending on the reverse side is indicated by dashed lines.

As noted before, in the decoration-making assist tool A1, the numerical marks 13, 23 are applied such that, of the recesses 11A, 11B and the ends 121, 122, 221, 222 of the elongated holes 12, 22, the paired ones which communicate with each other are provided with a same number. Further, successive numbers are applied to one end 121 (221) and the other end 122 (222) of each elongated hole 12 (22). Thus, by just following the numbers of the numerical mark 13, 23, the user can pass the needle in the proper order alternately through the first to the sixth elongated holes 22 (22A-22F) and though the first to the fifth elongated holes 12 (12A-12E). This ensures proper and efficient sewing work.

During the sewing work using the decoration-making assist tool A1, the lock 4 keeps the plates 1 and 2 in the properly overlapping state. Thus, it is not necessary to hold the plates 1 and 2 with a hand to keep the overlapping state. Further, when the plates 1 and 2 are in the overlapping state, the projections 15 and 25 prevent the cloth 6 from moving. This also allows proper and efficient sewing work.

The width of the two ends 121, 122 (221, 222) of each elongated hole 12 (22) are made larger than that of the intermediate portion 123 (223). This arrangement facilitates the work of inserting a needle into the ends 121, 122 (221, 222) and allows the user to easily find the position where the needle is to be inserted. Thus, this arrangement is suitable for performing the sewing work properly and efficiently.

After the sewing work is finished, the decoration-making assist tool A1 is removed from the cloth 6. The decoration-making assist tool A1 can be removed easily by disengaging the lock 4 and unfolding the plates 1 and 2. As will be understood from FIGS. 9A and 9B, this is because the stitch stretches between the ends 121, 122 (221, 22) of each elongated hole 12 (22), and the thread 5 connected to the end of the stitch passes through the recesses 11A, 11B.

Figure 11:
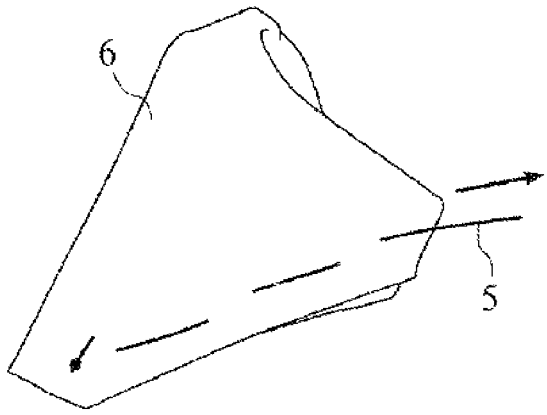
FIG. 11 shows a step in the process of making a decoration item.
Figure 12:
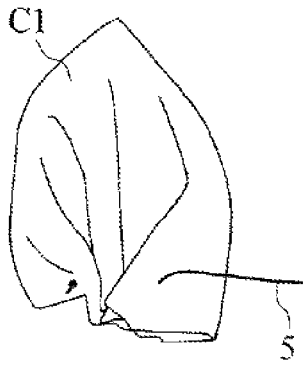
FIG. 12 shows a step in the process of making a decoration item.
Figure 13:
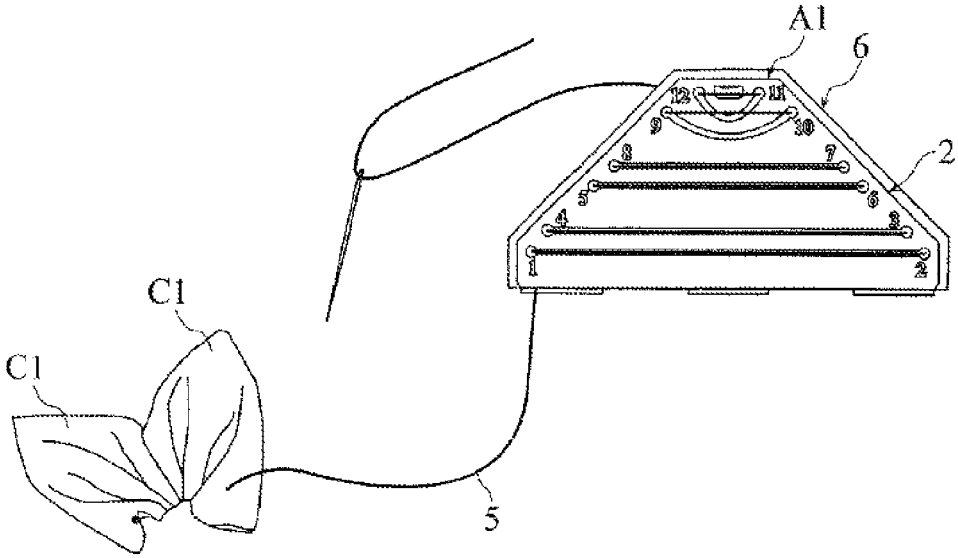
FIG. 13 shows a step in the process of making a decoration item using the decoration-making assist tool shown in FIG. 1.
Figure 14:
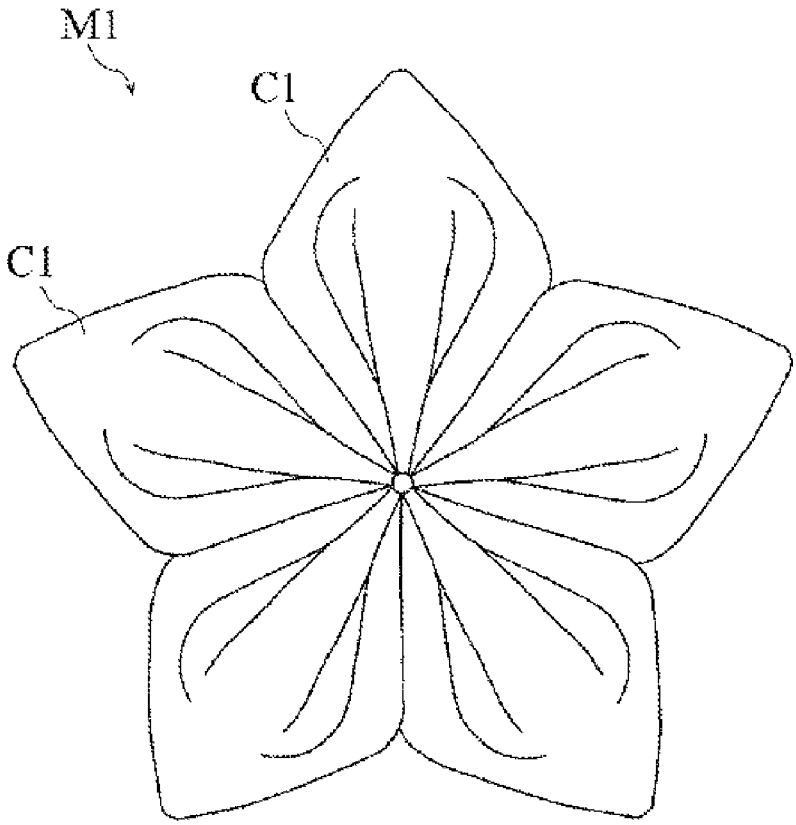
FIG. 14 is a plan view showing an example of a decoration item made using the decoration-making assist tool shown in FIG. 1.

Then as shown in FIG. 11, the cloth 6 is folded into half by tightening the thread 5. Then, as shown in FIG. 12, the thread 5 is further tightened to make folds in the cloth 6. Thus, a decoration unit C1 having a shape similar to a petal is obtained. The ends 121, 122, 221, 222 of the elongated holes 12, 22 of the plates 1, 2 are positioned adjacent to the peripheral edge 1*b*, 2*b* of the plate 1, 2. Thus, the stitch on the folded cloth 6 stretches adjacent to the periphery of the cloth 6. Thus, when the thread 5 is tightened, one edge of the cloth 6 is constricted, which allows the formation of the decoration unit C1 as shown in FIG. 12.

Then, some more decoration units C1 are made by using the thread 5 extending from the decoration unit C1 already made as described above (see FIG. 13). These decoration units C1 are made in the same manner as described above with reference to FIGS. 6-12. For instance, in this embodiment, five decoration units C1 are made. Then, the needle is passed through the root portion of the decoration unit C1 made first. Then, the thread is tightened, and fixed by making a knot. As a result, a decoration item M1 comprising a set of decoration units C1 and having a shape similar to a flower is obtained. As will be understood from the above description, the use of the decoration-making assist tool A1 ensures that a decoration item M comprising a plurality of decoration units C1 having a uniform fold configuration is made easily and efficiently.

Figure 15:
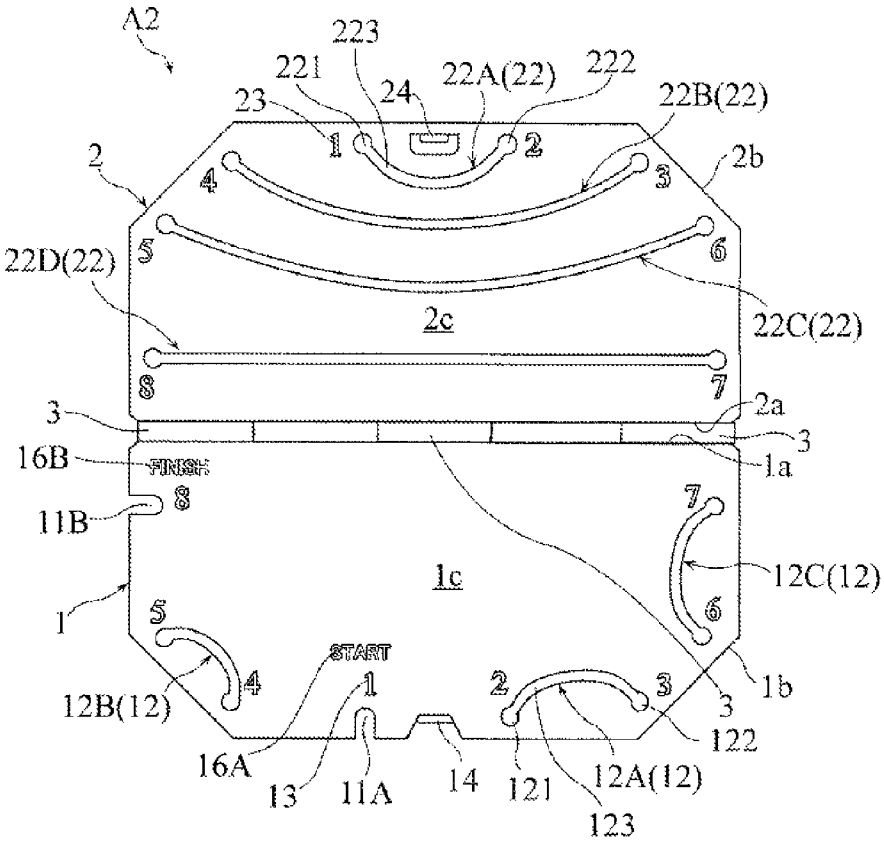
FIG. 15 is a plan view showing a decoration-making assist tool according to a second embodiment of the present invention.

FIG. 15 shows a decoration-making assist tool according to a second embodiment of the present invention. In FIG. 15 and the subsequent drawings, the elements that are identical or similar to those of the foregoing embodiment are designated by the same reference signs as those used for the foregoing embodiment, and the description is omitted appropriately.

Figure 16:
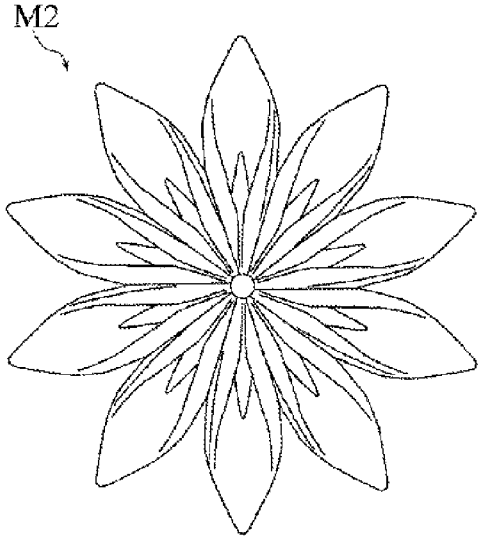
FIG. 16 is a plan view showing an example of a decoration item made using the decoration-making assist tool shown in FIG. 15.

The decoration-making assist tool A2 includes plates 1 and 2, and its basic structure is the same as that of the decoration-making assist tool A1 of the foregoing embodiment. The decoration-making assist tool A2 is designed to make a decoration item M2 (see FIG. 16) having a shape different from that of the decoration item M1 made by using the decoration-making assist tool A1. Accordingly, the decoration-making assist tool A2 is partially different from the decoration-making assist tool A1, in accordance with the difference in shape of the decoration item to be made.

Specifically, the decoration-making assist tool A2 is different from the decoration-making assist tool A1 in shape of the peripheral edges 1*b*, 2*b* and arrangement of the recesses 11A, 11B and elongated holes 12, 22. Further, in this embodiment, the plate 1 is formed with three, i.e., a first to a third elongated holes 12A-12C, whereas the plate 2 is formed with four, i.e., a first to a fourth elongated holes 22A-22D. That is, the number of the elongated holes 12 and the number of the elongated holes 22 of the decoration-making assist tool A2 are respectively smaller than those of the decoration-making assist tool A1 by two. Except these differences, the structure of the decoration-making assist tool A2 is substantially the same as that of the decoration-making assist tool A1. Similarly to the first embodiment described above, the recesses 11A, 11B and the ends 121, 122 of the elongated holes 12A-12C of the plate 1 and the ends 221, 222 of the elongated holes 22A-22D of the plate 2 are arranged such that corresponding ones communicate with each other when the plates 1 and 2 overlap each other. The decoration-making assist tool A2 is used in a manner basically similar to that of the first embodiment described with reference to FIGS. 6-13.

Figure 17:
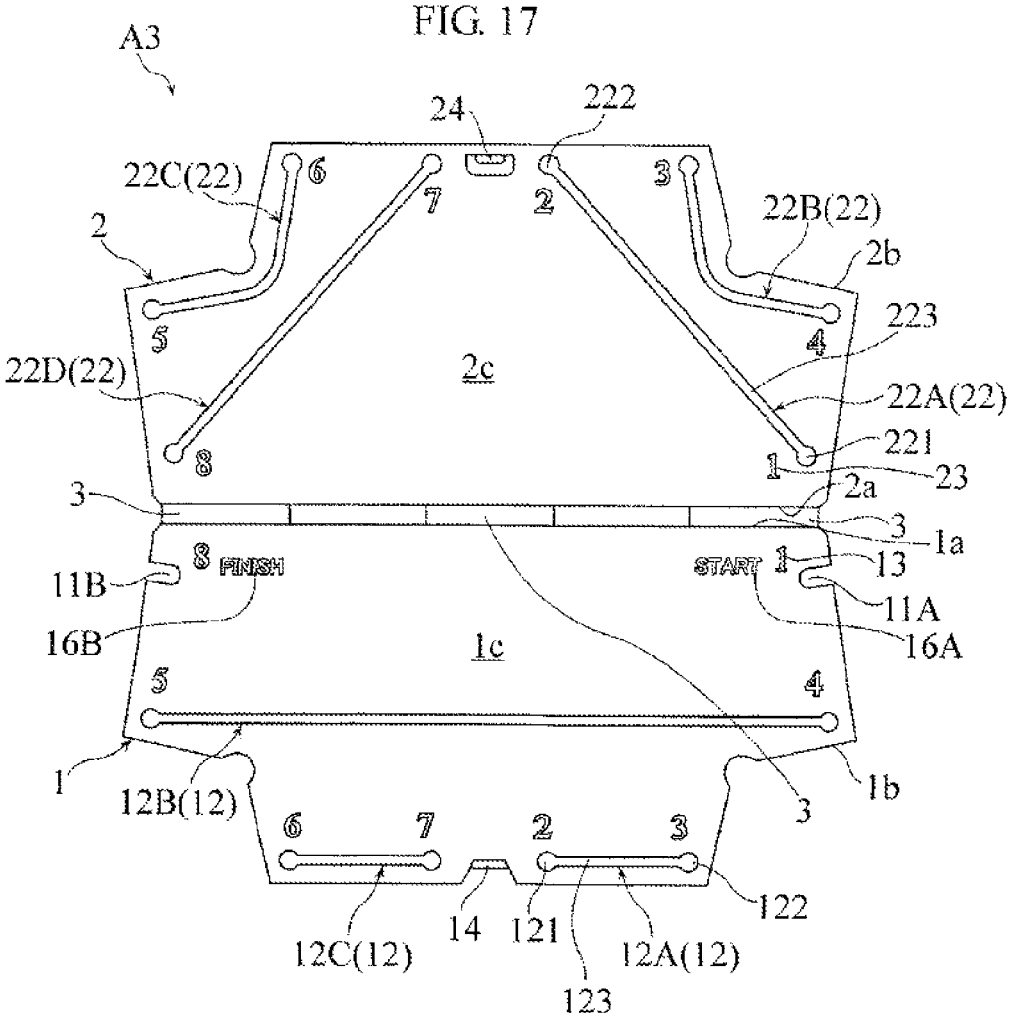
FIG. 17 is a plan view showing a decoration-making assist tool according to a third embodiment of the present invention.
Figure 18:
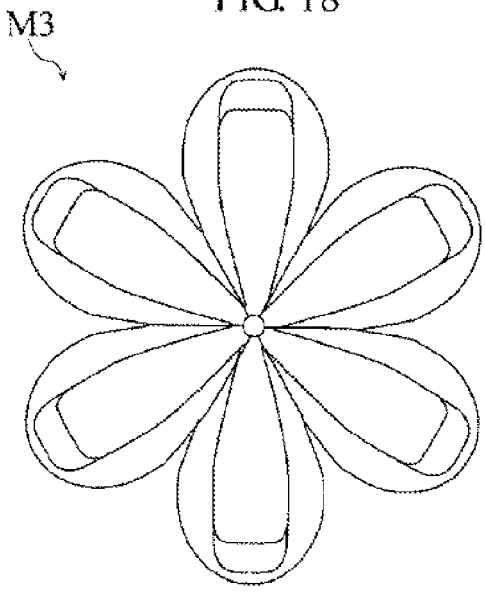
FIG. 18 is a plan view showing an example of a decoration item made using the decoration-making assist tool shown in FIG. 17.

FIG. 17 shows a decoration-making assist tool according to a third embodiment of the present invention. The decoration-making assist tool A3 shown in the figure includes plates 1 and 2, and its basic structure is the same as that of the decoration-making assist tool A1 of the foregoing embodiment. The decoration-making assist tool A3 is designed to make a decoration item M3 (see FIG. 18) having a shape different from that of the decoration item M1 made by using the decoration-making assist tool A1. Accordingly, the decoration-making assist tool A3 is partially different from the decoration-making assist tool A1, in accordance with the difference in shape of the decoration item to be made.

Specifically, the decoration-making assist tool A3 is different from the decoration-making assist tool A1 in shape of the peripheral edges 1*b*, 2*b* and arrangement of the recesses 11A, 11B and elongated holes 12, 22. Further, in this embodiment, the plate 1 is formed with three, i.e., a first to a third elongated holes 12A-12C, whereas the plate 2 is formed with four, i.e., a first to a fourth elongated holes 22A-22D. That is, the number of the elongated holes 12 and the number of the elongated holes of the decoration-making assist tool A3 are respectively smaller than those of the decoration-making assist tool A1 by two. Except these differences, the structure of the decoration-making assist tool A3 is substantially the same as that of the decoration-making assist tool A1. Similarly to the first embodiment described above, the recesses 11A, 11B and the ends 121, 122 of the elongated holes 12A-12C of the plate 1 and the ends 221, 222 of the elongated holes 22A-22D of the plate 2 are arranged such that corresponding ones communicate with each other when the plates 1 and 2 overlap each other. The decoration-making assist tool A3 is used in a manner basically similar to that of the first embodiment described with reference to FIGS. 6-13.

Figure 19:
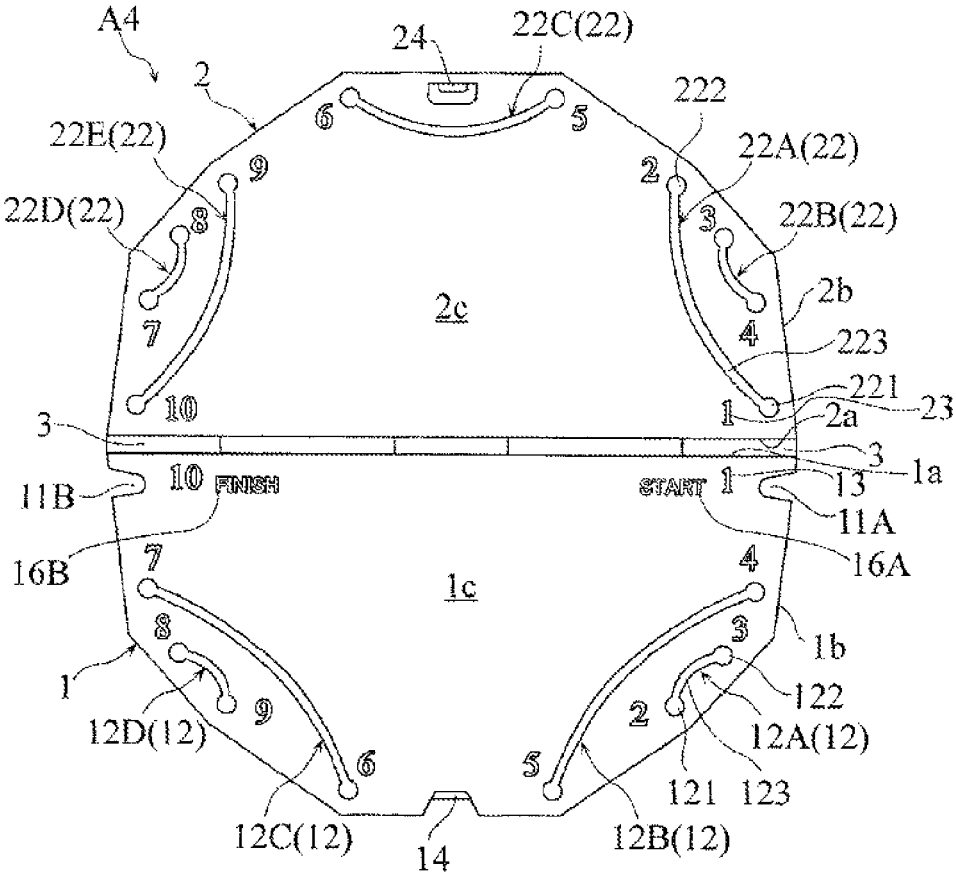
FIG. 19 is a plan view showing a decoration-making assist tool according to a fourth embodiment of the present invention.
Figure 20:
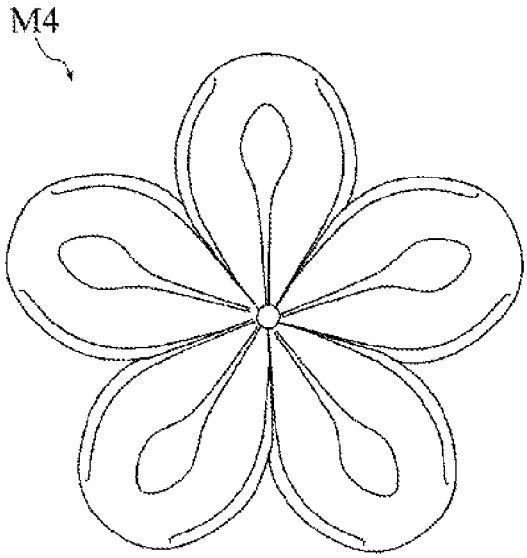
FIG. 20 is a plan view showing an example of a decoration item made using the decoration-making assist tool shown in FIG. 19.

FIG. 19 shows a decoration-making assist tool according to a fourth embodiment of the present invention. The decoration-making assist-tool A4 includes plates 1 and 2, and its basic structure is the same as that of the decoration-making assist tool A1 of the foregoing embodiment. The decoration-making assist tool A4 is designed to make a decoration item M4 (see FIG. 20) having a shape different from that of the decoration item M1 made by using the decoration-making assist tool A1. Accordingly, the decoration-making assist tool A4 is partially different from the decoration-making assist tool A1, in accordance with the difference in shape of the decoration item to be made.

Specifically, the decoration-making assist tool A4 is different from the decoration-making assist tool A1 in shape of the peripheral edges 1*b*, 2*b* and arrangement of the recesses 11A, 11B and elongated holes 12, 22. Further, in this embodiment, the plate 1 is formed with four, i.e., a first to a fourth elongated holes 12A-12D, whereas the plate 2 is formed with five, i.e., a first to a fifth elongated holes 22A-22E. That is, the number of the elongated holes 12 and the number of the elongated holes of the decoration-making assist tool A4 are respectively smaller than those of the decoration-making assist tool A1 by one. Except these differences, the structure of the decoration-making assist tool A4 is substantially the same as that of the decoration-making assist tool A1. Similarly to the first embodiment described above, the recesses 11A, 11B and the ends 121, 122 of the elongated holes 12A-12D of the plate 1 and the ends 221, 222 of the elongated holes 22A-22E of the plate 2 are arranged such that corresponding ones communicate with each other when the plates 1 and 2 overlap each other. The decoration-making assist tool A4 is used in a manner basically similar to that of the first embodiment described with reference to FIGS. 6-13.

Although embodiments of the present invention are described above, the technical scope of the present invention is not limited to these embodiments. The specific structure of each part of the decoration-making assist tool according to the present invention can be varied in many ways without departing from the spirit of the present invention. As will be understood from the above description of the embodiments, the decoration-making assist tool of the present invention is applicable to making various kinds of decoration items.

Although a plurality of decoration units are successively made using the same thread in the making of a decoration item according to the foregoing embodiments, the method of making a decoration item according to present invention is not limited to this. For instance, a plurality of separate decoration units may be made by forming a knot every time a single decoration unit is made, and then the decoration units may be sewed together to obtain a decoration item.

The invention claimed is:

1. A decoration-making assist tool for making a decoration item by sewing cloth, the tool comprising:

a first plate and a second plate each including a straight base edge and a peripheral edge connected to ends of the base edge; and a connecting portion connecting the first plate and the second plate to each other at the base edges such that the first plate and the second plate are pivotable relative to each other; wherein:

the peripheral edge of the first plate and the peripheral edge of the second plate are substantially symmetrical with respect to the connecting portion;

the first plate and the second plate are foldable to overlap each other;

the first plate includes a first and a second recesses indented inward at the peripheral edge and a first group of elongated holes including a first to an Nth elongated holes spaced from each other, where N is an integer equal to or greater than two;

the second plate includes a second group of elongated holes including a first to an (N+1)th elongated holes spaced from each other;

each of the elongated holes of the first group includes opposite ends positioned adjacent to the peripheral edge of the first plate, and each of the elongated holes of the second group includes opposite ends positioned adjacent to the peripheral edge of the second plate; and when the first plate and the second plate overlap each other, the first recess and one end of the first elongated hole of the second group communicate with each other, another end of an (i)th elongated hole of the second group communicates with one end of an (i)th elongated hole of the first group, where i is an integer satisfying $1 \leqq i \leqq N$, another end of the (i)th elongated hole of the first group communicates with one end of an (i+1)th elongated hole of the second group, and another end of the (N+1)th elongated hole of the second group communicates with the second recess.

2. The decoration-making assist tool according to claim 1, wherein, the first and the second plates are provided with numerical marks for showing an order in which a needle is to be passed through, the numerical marks being adjacent to the first and the second recesses and the opposite ends of the elongated holes of the first and the second groups.

3. The decoration-making assist tool according to claim 2, wherein the numerical marks are applied such that, of the first and the second recesses and the opposite ends of each of the elongated holes of the first and the second groups, paired ones that communicate with each other when the first plate and the second plate overlap each other are provided with a same number, while the opposite ends of each of the elongated holes of the first group and the second group are provided with successive numbers.

4. The decoration-making assist tool according to claim 1, wherein the opposite ends of each of the elongated holes of the first and the second groups are larger in width than an intermediate portion of the elongated hole connected to the opposite ends.

5. The decoration-making assist tool according to claim 1, further comprising a lock for keeping an overlapping state of the first and the second plates.

6. The decoration-making assist tool according to claim 1, wherein the first plate and the second plate include surfaces that face each other when the first plate and the second plate overlap each other, the surfaces being formed with projections extending in a direction in which the base edges extend.

7. A method of making a decoration item by using the decoration-making assist tool according to claim 1, the method comprising:

a first step of sandwiching a piece of cloth between the first plate and the second plate by placing the piece of cloth on the first plate and the second plate when these plates are unfolded, and folding the first plate and the second plate to overlap each other;

a second step of cutting off an unnecessary portion of the piece of cloth along the peripheral edges of the first plate and the second plate in the overlapping state;

a third step of sewing the piece of cloth by a needle with a thread by inserting the needle into the first recess of the first plate and pulling out the needle from one end of the first elongated hole of the second group of the second plate, inserting the needle into said another end of the (i)th elongated hole of the second group of the second plate and pulling out the needle from one end of the (i)th elongated hole of the first group of the first plate, inserting the needle into said another end of the (i)th elongated hole of the first group of the first plate and pulling out the needle from one end of the (i+1)th elongated hole of the second group of the second plate, inserting the needle into said another end of the (N+1)th elongated hole of the second group of the second plate and pulling out the needle from the second recess of the first plate;

a fourth step of removing the piece of cloth from the decoration-making assist tool by unfolding the first plate and the second plate; and a fifth step of forming a decoration unit by tightening the thread.

8. The method of making a decoration item according to claim 7, wherein by using the thread extending from the decoration unit, the first through the fifth steps are performed again to make another decoration unit so that an decoration item including the decoration units is obtained.

* * * * *